US010131974B2

(12) United States Patent
Jun et al.

(10) Patent No.: US 10,131,974 B2
(45) Date of Patent: Nov. 20, 2018

(54) HIGH SILICON BEARING DUAL PHASE STEELS WITH IMPROVED DUCTILITY

(71) Applicant: ARCELORMITTAL, Luxembourg (LU)

(72) Inventors: Hyun Jo Jun, Valparaiso, IN (US); Narayan S. Pottore, Munster, IN (US); Nina Michailovna Fonstein, Chicago, IL (US)

(73) Assignee: ArcelorMittal, Luxembourg (LU)

( * ) Notice: Subject to any disclaimer, the term of this patent is extended or adjusted under 35 U.S.C. 154(b) by 469 days.

(21) Appl. No.: 14/361,292

(22) PCT Filed: Nov. 28, 2012

(86) PCT No.: PCT/US2012/066877

§ 371 (c)(1),
(2) Date: May 28, 2014

(87) PCT Pub. No.: WO2013/082171

PCT Pub. Date: Jun. 6, 2013

(65) Prior Publication Data

US 2015/0267280 A1 Sep. 24, 2015

Related U.S. Application Data

(60) Provisional application No. 61/629,757, filed on Nov. 28, 2011.

(51) Int. Cl.

| | |
|---|---|
| ***C22C 38/00*** | (2006.01) |
| ***C22C 38/02*** | (2006.01) |
| ***C22C 38/12*** | (2006.01) |
| ***C22C 38/04*** | (2006.01) |
| ***C22C 38/06*** | (2006.01) |
| ***C21D 9/40*** | (2006.01) |

(52) U.S. Cl.
CPC ..... *C22C 38/12* (2013.01); *C21D 9/40* (2013.01); *C22C 38/00* (2013.01); *C22C 38/001* (2013.01); *C22C 38/02* (2013.01); *C22C 38/04* (2013.01); *C22C 38/06* (2013.01)

(58) Field of Classification Search
CPC ..... C22C 38/00; C22C 38/02; C22C 38/12
USPC ..... 148/320
See application file for complete search history.

(56) References Cited

U.S. PATENT DOCUMENTS

| | | | |
|---|---|---|---|
| 6,743,307 | B1 | 6/2004 | Engl et al. |
| 7,527,700 | B2 | 1/2006 | Kariya et al. |
| 7,507,307 | B2 | 3/2009 | Hasegawa et al. |
| 7,919,194 | B2 | 4/2011 | Kawamura et al. |
| 8,465,600 | B2 | 6/2013 | Watanabe et al. |
| 2004/0238082 | A1 | 12/2004 | Hasegawa et al. |

(Continued)

FOREIGN PATENT DOCUMENTS

| | | |
|---|---|---|
| CN | 1566389 | 1/2005 |
| JP | 0499226 | 3/1992 |

(Continued)

*Primary Examiner* — Brian D Walck
(74) *Attorney, Agent, or Firm* — Jennifer L. O'Connell; William C. Gehris; Davidson, Davidson & Kappel

(57) ABSTRACT

A dual phase steel (martensite+ferrite) having a tensile strength of at least 980 MPa, and a total elongation of at least 15%. The dual phase steel may have a total elongation of at least 18%. The dual phase steel may also have a tensile strength of at least 1180 MPa. The dual phase steel may include between 0.5-3.5 wt. % Si, and more preferably between 1.5-2.5 wt. % Si.

12 Claims, 7 Drawing Sheets

(56) References Cited

U.S. PATENT DOCUMENTS

| | | | |
|---|---|---|---|
| 2005/0139293 | A1 | 6/2005 | Masahiro et al. |
| 2010/0108200 | A1 | 5/2010 | Futamura et al. |
| 2011/0240176 | A1 | 10/2011 | Kaneko et al. |

FOREIGN PATENT DOCUMENTS

| | | | |
|---|---|---|---|
| JP | 0499227 | | 3/1992 |
| JP | 2004256872 | | 9/2004 |
| JP | 4503001 | B2 | 6/2008 |
| JP | 2010159453 | A | 7/2010 |
| JP | 2010255094 | | 11/2010 |
| JP | 2011080106 | | 4/2011 |
| JP | 2011162813 | | 8/2011 |
| JP | 2011219784 | | 11/2011 |

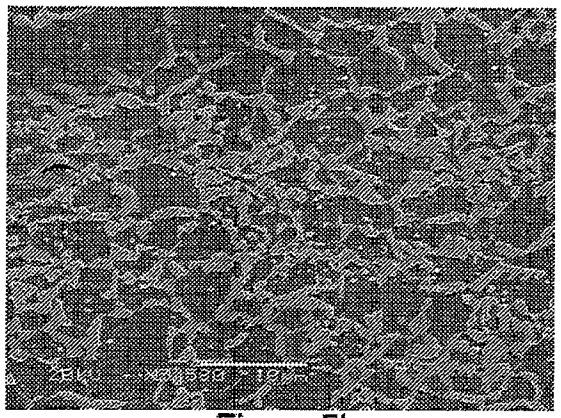
Figure 5a
Figure 5b
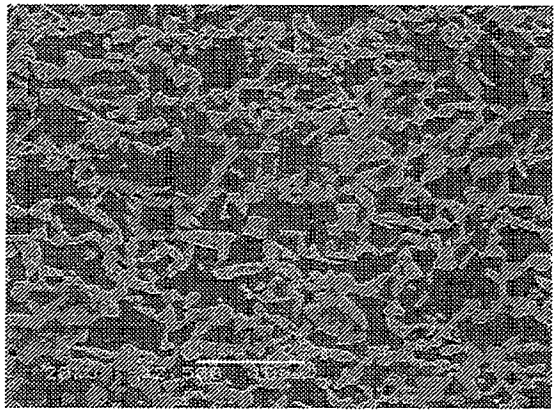
Figure 5c
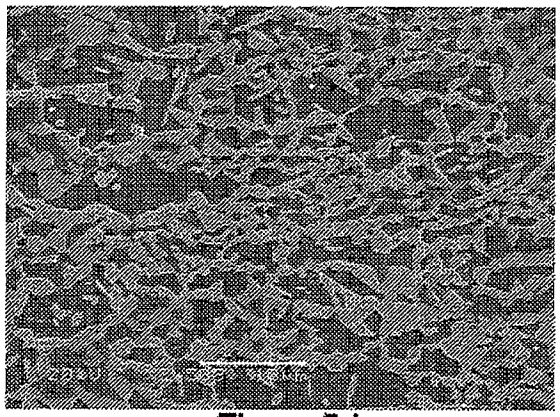
Figure 5d

HIGH SILICON BEARING DUAL PHASE STEELS WITH IMPROVED DUCTILITY

CROSS-REFERENCE TO RELATED APPLICATIONS

This application is the U.S. National Stage Application (filed under 35 U.S.C. 371) of prior International Application No. PCT/US12/66877, filed Nov. 28, 2012, and published on Jun. 6, 2013 as WO/2013/082171, which claims the benefit of/priority to U.S. Provisional Application No. filed Nov. 28, 2011.

FIELD OF THE INVENTION

The present invention relates generally to dual phase (DP) steels. More specifically the present invention relates to DP steel having a high silicon content ranging between 0.5-3.5 wt. %. Most specifically the present invention relates to high Si bearing DP steels with improved ductility through water quenching continuous annealing.

BACKGROUND OF THE INVENTION

As the use of high strength steels increases in automotive applications, there is a growing demand for steels of increased strength without sacrificing formability. Dual phase (DP) steels are a common choice because they provide a good balance of strength and ductility. As martensite volume fraction continues to increase in newly developed steels, increasing strength even further, ductility becomes a limiting factor. Silicon is an advantageous alloying element because it has been found to shift the strength-ductility curve up and to the right in DP steels. However, silicon forms oxides which can cause adhesion issues with zinc coatings, so there is pressure to minimize silicon content while achieving the required mechanical properties.

Thus, there is a need in the art for DP steels having an ultimate tensile strength greater than or equal to about 980 MPa and a total elongation of greater than or equal to about 15%.

SUMMARY OF THE INVENTION

The present invention is a dual phase steel (martensite+ferrite). The dual phase steel has a tensile strength of at least 980 MPa, and a total elongation of at least 15%. The dual phase steel may have a total elongation of at least 18%. The dual phase steel may also have a tensile strength of at least 1180 MPa.

The dual phase steel may include between 0.5-3.5 wt. % Si, and more preferably between 1.5-2.5 wt. % Si. The dual phase steel may further include between 0.1-0.3 wt. % C, more preferably between 0.14-0.21 wt % C and most preferably less than 0.19 wt. % C, such as about 0.15 wt. % C. The dual phase steel may further include between 1-3 wt. % Mn, more preferably between 1.75-2.5 wt % Mn, and most preferably about 1.8-2.2 wt % Mn.

The dual phase steel may further include between 0.05-1 wt % Al, between 0.005-0.1 wt. % total of one or more elements selected from the group consisting of Nb, Ti, and V, and between 0-0.3 wt. % Mo.

BRIEF DESCRIPTION OF THE DRAWINGS

FIGS. 5*a*-5*d* are SEM micrographs of samples annealed at: 5*a*=750° C., 5*b*=775° C., 5*c*=800° C. and 5*d*=825° C., showing the microstructure of the annealed samples;

DETAILED DESCRIPTION OF THE INVENTION

Figure 1A:
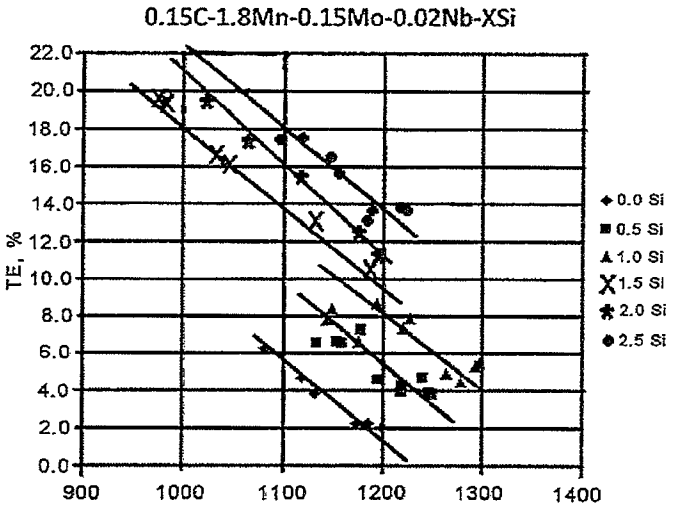
FIGS. 1*a* and 1*b* plot TE vs TS for 0.15C-1.8Mn-0.15Mo-0.02Nb-XSi and 0.20C-1.8Mn-0.15Mo-0.02Nb—XSi for varied silicon between 1.5-2.5 wt. %.

The present invention is a family of Dual Phase (DP) microstructure (ferrite+martensite) steels. The steels have minimal to no retained austenite. The inventive steels have a unique combination of high strength and formability. The tensile properties of the present invention preferably provide for multiple steel products. One such product has an ultimate tensile strength (UTS)≥980 MPa with a total elongation (TE)≥18%. Another such product will have UTS≥1180 MPa and TE≥15%.

Broadly the alloy has a composition (in wt %) including C: 0.1-0.3; Mn: 1-3, Si: 0.5-3.5; Al: 0.05-1, optionally Mo: 0-0.3, Nb, Ti, V: 0.005-0.1 total, the remainder being iron and inevitable residuals such as S, P, and N. More preferably the carbon is in a range of 0.14-0.21 wt %, and is preferred below 0.19 wt. % for good weldability. Most preferably the carbon is about 0.15 wt % of the alloy. The manganese content is more preferably between 1.75-2.5 wt %, and most preferably about 1.8-2.2 wt %. The silicon content is more preferably between 1.5-2.5 wt %.

EXAMPLES

WQ-CAL (water quenching continuous annealing line) is utilized to produce lean chemistry based martensitic and DP grades due to its unique water quenching capability. Therefore, the present inventors have focused on DP microstructure through WQ-CAL. In DP steels, ferrite and martensite dominantly govern ductility and strength, respectively. Therefore, strengthening of both ferrite and martensite is required to achieve high strength and ductility, simultaneously. The addition of Si effectively increases the strength of ferrite and facilitates a lower fraction of martensite to be utilized to produce the same strength level. Consequently, the ductility in DP steels is enhanced. High Si bearing DP steel has therefore been chosen as the main metallurgical concept.

In order to analyze the metallurgical effects of high Si bearing DP steels, laboratory heats with various amounts of Si have been produced by vacuum induction melting. Chemical composition of the investigated steels is listed in Table 1. The first six steels are based on 0.15C-1.8Mn-0.15Mo-0.02Nb with Si content ranging from 0-2.5 wt. %. The others have 0.2% C with 1.5-2.5 wt. % Si. It should be noted that although these steels contain 0.15 wt. % Mo, Mo addition is not required to produce a DP microstructure through WQ-CAL. Thus Mo is an optional element in the alloy family of the present invention.

TABLE 1

| ID | C | Mn | Si | Nb | Mo | Al | P | S | N |
|---|---|---|---|---|---|---|---|---|---|
| 15C0Si | 0.15 | 1.77 | 0.01 | 0.019 | 0.15 | 0.037 | 0.008 | 0.005 | 0.0055 |
| 15C5Si | 0.14 | 1.75 | 0.5 | 0.019 | 0.15 | 0.05 | 0.009 | 0.005 | 0.0055 |
| 15C10Si | 0.15 | 1.77 | 0.98 | 0.019 | 0.15 | 0.049 | 0.009 | 0.004 | 0.0055 |
| 15C15Si | 0.14 | 1.8 | 1.56 | 0.017 | 0.15 | 0.071 | 0.008 | 0.005 | 0.005 |
| 15C20Si | 0.15 | 1.86 | 2.02 | 0.018 | 0.16 | 0.067 | 0.009 | 0.005 | 0.0053 |
| 15C25Si | 0.14 | 1.86 | 2.5 | 0.018 | 0.16 | 0.075 | 0.008 | 0.005 | 0.0053 |
| 20C15Si | 0.2 | 1.8 | 1.56 | 0.017 | 0.15 | 0.064 | 0.009 | 0.005 | 0.0061 |
| 20C20Si | 0.21 | 1.85 | 1.99 | 0.018 | 0.16 | 0.068 | 0.008 | 0.005 | 0.0055 |
| 20C25Si | 0.21 | 1.85 | 2.51 | 0.018 | 0.16 | 0.064 | 0.008 | 0.005 | 0.0056 |

Figure 1B:
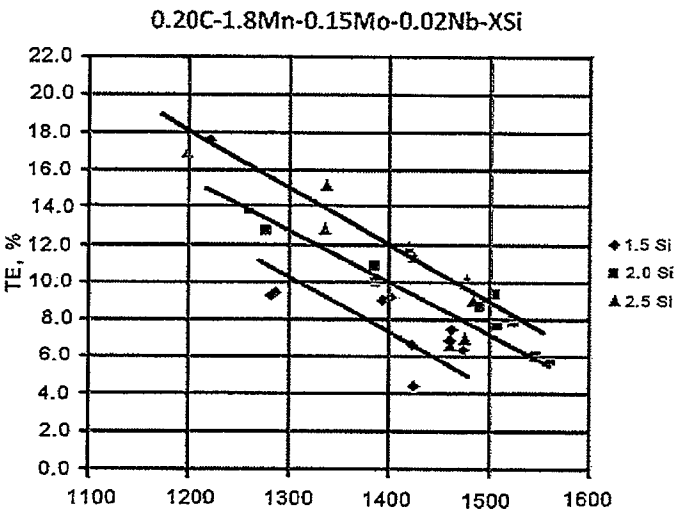
Figure 2B:
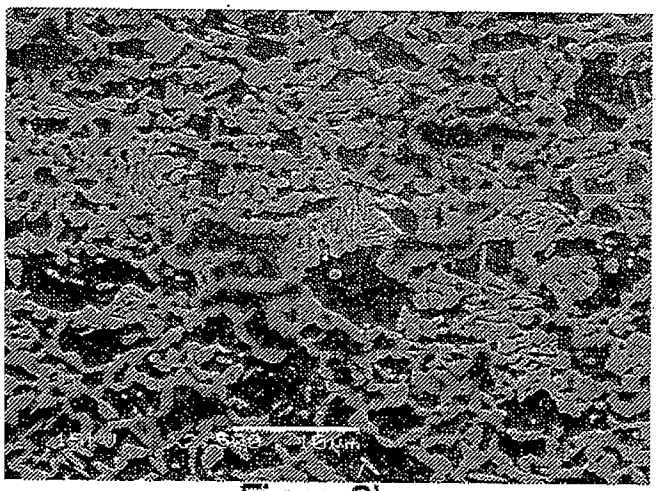
FIGS. 2*a* and 2*b* are SEM micrographs from 0.2% C steels having similar TS of about 1300 MPa at two Si levels. 2*a* at 1.5% Si and 2*b* at 2.5% Si.
Figure 2A:
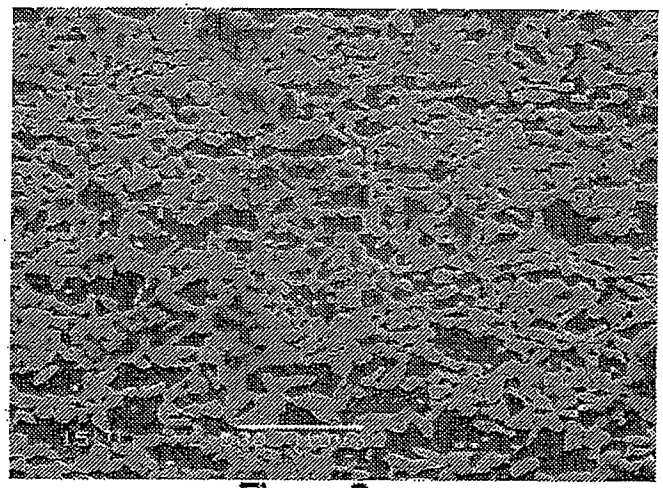

After hot rolling with aim FT 870° C. and CT 580° C., both sides of the hot bands were mechanically ground to remove the decarburized layers prior to cold rolling with a reduction of about 50%. The full hard materials were annealed in a high temperature salt pot from 750 to 875° C. for 150 seconds, quickly transferred to a water tank, followed by a tempering treatment at 400/420° C. for 150 seconds. A high overaging temperature has been chosen in order to improve the hole expansion and bendability of the steels. Two JIS-T tensile tests were performed for each condition. FIGS. 1*a* and 1*b* plot TE vs TS for 0.15C-1.8Mn-0.15Mo-0.02Nb-XSi and 0.20C-1.8Mn-0.15Mo-0.02Nb-XSi for varied silicon between 1.5-2.5 wt. %. FIGS. 1*a* and 1*b* show the effect of Si addition on the balance between tensile strength and total elongation. The increase in Si content clearly enhances the ductility at the same level of tensile strength in both 0.15% C and 0.20% C steels. FIGS. 2*a* and 2*b* are SEM micrographs from 0.2% C steels having similar TS of about 1300 MPa at two Si levels. 2*a* at 1.5 wt. % Si and 2*b* at 2.5 wt % Si. FIGS. 2*a* and 2*b* confirm that higher Si has more ferrite fraction at a similar level of tensile strength (TS about 1300 MPa). In addition, XRD results reveal no retained austenite in the annealed steels resulting in no TRIP effect by adding Si.

Annealing Properties of 2.5% Si Bearing Steel

Since 0.2% C steel with 2.5 wt. % Si achieves useful tensile properties, as shown in FIG. 1, further analysis of 0.2 wt. % C and 2.5 wt % Si steel was performed.

Hot/Cold Rolling

Figures 3A, 3B:
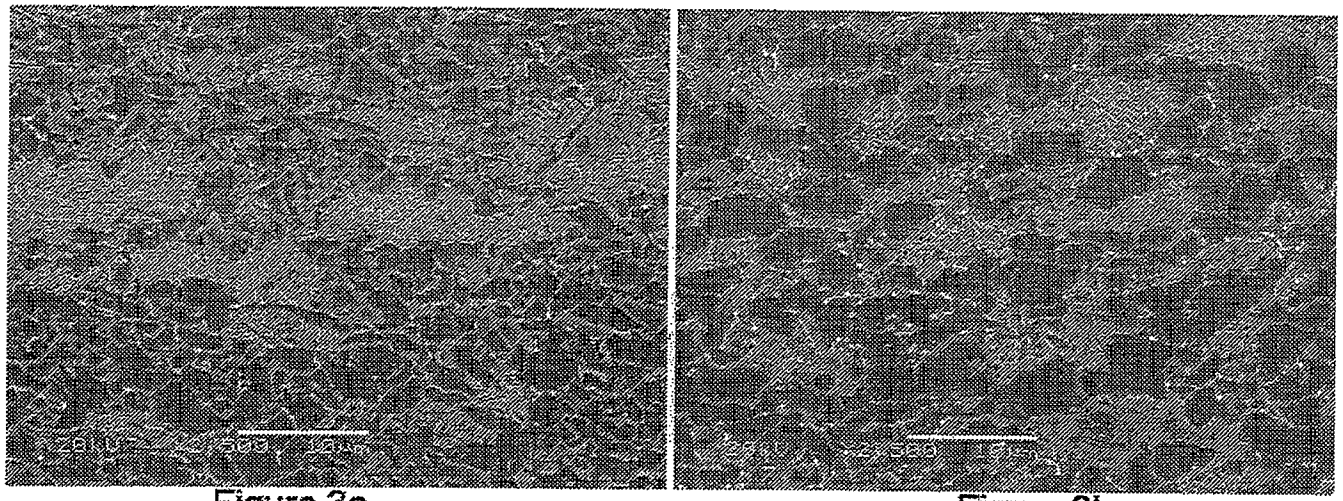
FIGS. 3*a* and 3*b* are SEM micrographs of hot bands at CTs of 580° C. and 620° C., respectively from which the microstructures of the steels may be discerned.

Two hot rolling schedules with different coiling temperatures (CT) of 580 and 620° C. and the same aim finishing temperature (FT) of 870° C. have been conducted using a 0.2 wt. % C and 2.5 wt. % Si steel. Tensile properties of the generated hot bands are summarized in Table 2. Higher CT produces higher YS, lower TS and better ductility. Lower CT promotes the formation of bainite (bainitic ferrite) resulting in lower YS, higher TS and lower TE. However, the main microstructure consists of ferrite and pearlite at both CTs. FIGS. 3*a* and 3*b* are SEM micrographs of hot bands at CTs of 580° C. and 620° C., respectively from which the microstructures of the steels may be discerned. There is no major issue for cold mill load since both CTs have lower strength than GA DP T980. In addition, Mo addition is not required to produce DP microstructure with WQ-CAL. The composition without Mo will soften hot band strength in all ranges of CT. After mechanical grinding to remove the decarburized layers, the hot bands were cold rolled by about 50% on the laboratory cold mill.

TABLE 2

| Grade | CT, ° C. | YS, Mpa | TS, Mpa | UE, % | TE, % | YPE, % |
|---|---|---|---|---|---|---|
| 0.2C—1.8Mn—2.5Si—0.15Mo—0.02Nb | 580 | 451 | 860 | 9.9 | 17.7 | 0 |
| | 620 | 661 | 818 | 14.7 | 22.3 | 3.3 |

Annealing

Figure 4A:
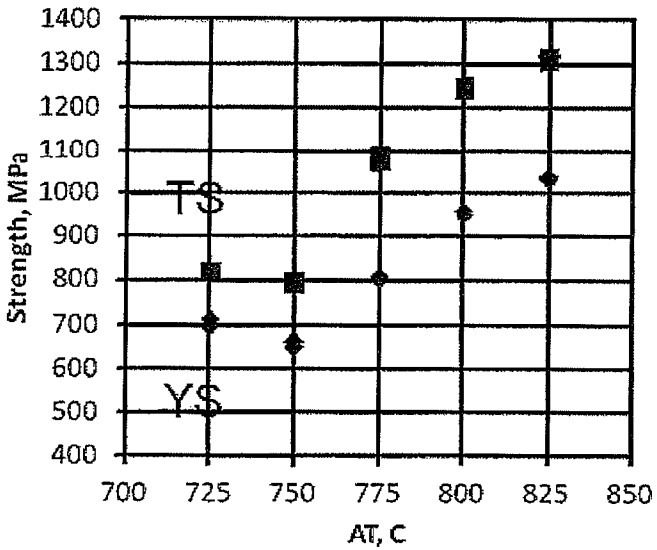
FIGS. 4*a* and 4*b* plot the tensile properties strength (both TS and YS) and TE, respectively, as a function of annealing temperature (AT) with a Gas Jet Cool (GJC) temperature of 720° C. and an Overage (OA) temperature of 400° C.
Figure 4B:
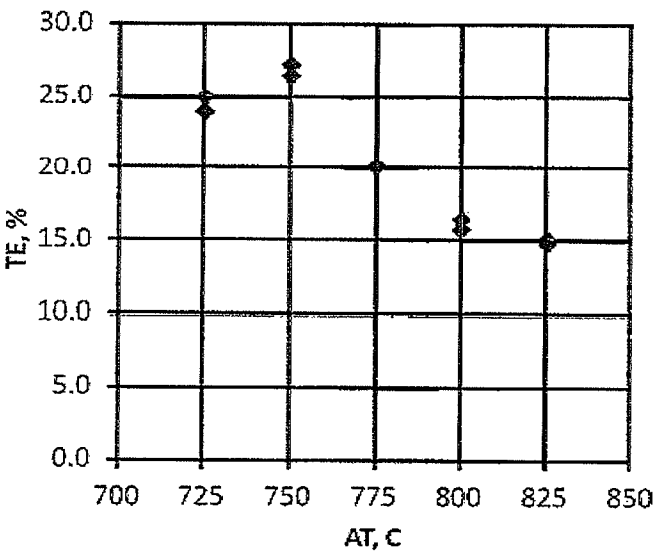

Annealing simulations were performed on full hard steels produced from hot bands with CT 620° C., using salt pots. The full hard materials were annealed at various temperatures from 775 to 825° C. for 150 seconds, followed by a treatment at 720° C. for 50 seconds to simulate gas jet cooling and then quickly water quenched. The quenched samples were subsequently overaged at 400° C. for 150 seconds. High OAT of 400° C. was chosen to improve hole expansion and bendability. FIGS. 4*a* and 4*b* plot the tensile properties strength (both TS and YS) and TE, respectively, as a function of annealing temperature (AT) with a Gas Jet Cool (GJC) temperature of 720° C. and an Overage (OA) temperature of 400° C. Both YS and TS increase with AT at the cost of TE. An annealing temperature of 800° C. with GJC 720° C. and OAT 400° C. can produce steel with a YS of about 950 MPa, TS of about 1250 MPa and TE of about 16%. It should be noted that this composition can produce multiple grades of steel at varying TS level from 980 to 1270 MPa: 1) YS=800MPa, TS=1080MPa and TE=20%; and 2) YS=1040MPa, TS=1310MPa, and TE=15% (see Table 3). FIGS. 5*a*-5*d* are SEM micrographs of samples annealed at: 5*a*=750° C., 5*b*=775° C., 5*c*=800° C. and 5*d*=825° C., showing the microstructure of the annealed samples. The sample annealed at AT 750° C. still contains undissolved cementites in a fully recrystallized ferrite matrix resulting in high TE and YPE. Starting from AT 775° C., it produces a dual phase microstructure of ferrite and tempered martensite. The sample processed at AT 800° C. contains a martensite fraction of about 40% and exhibits a TS of about 1180 MPa; similar to current industrial DP steel with TS of 980 with lower Si content that also contains about 40% martensite. A potential combination of higher TS and TE in high Si DP steels processed at AT of 825° C. and higher can be expected. Hole expansion (HE) and 90° free V bend tests were performed on the samples annealed at 800° C. Hole expansion and bendability demonstrated average 22% (std. dev. of 3% and based on 4 tests) and 1.1 r/t, respectively.

TABLE 3

| AT, ° C. | Gauge, mm | YS, MPa | TS, MPa | UE, % | TE, % | YPE, % |
|---|---|---|---|---|---|---|
| 725 | 1.5 | 698 | 814 | 15.3 | 25 | 4.6 |
| 725 | 1.5 | 712 | 819 | 14.9 | 24 | 5 |
| 750 | 1.5 | 664 | 797 | 15.8 | 26.5 | 4.2 |
| 750 | 1.5 | 650 | 790 | 15.1 | 27.2 | 2.7 |
| 775 | 1.5 | 808 | 1074 | 13 | 20.3 | 0 |
| 775 | 1.5 | 803 | 1091 | 12.5 | 20.1 | 0.3 |
| 800 | 1.5 | 952 | 1242 | 9.7 | 16.5 | 2.4 |
| 800 | 1.5 | 959 | 1250 | 9 | 15.8 | 0 |
| 825 | 1.5 | 1038 | 1307 | 8.3 | 14.8 | 0 |
| 825 | 1.5 | 1034 | 1314 | 8.4 | 15.1 | 0 |

Table 4A presents the tensile properties of alloys of the present invention having the basic formula 0.15C-1.8Mn—Si-0.02Nb-0.15Mo, with varied Si between 1.5-2.5 wt. %. The cold rolled alloy sheets were annealed at varied temperatures between 750-900° C. and overage treated at 200° C.

Table 4B presents the tensile properties of alloys of the present invention having the basic formula 0.15C-1.8Mn—Si-0.02Nb-0.15Mo, with varied Si between 1.5-2.5 wt. %. The cold rolled alloy sheets were annealed at varied temperatures between 750-900° C. and overage treated at 420° C.

Figure 6A:
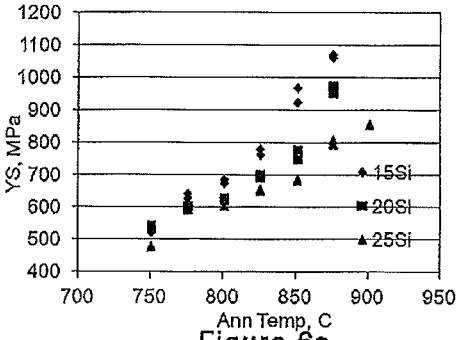
FIGS. 6*a*-6*e* plot the tensile properties versus annealing temperature for the samples of Table 4A.
Figure 6B:
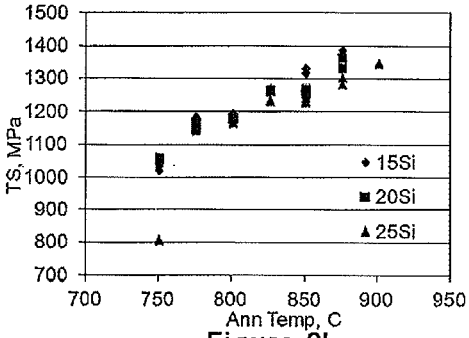
Figure 6C:
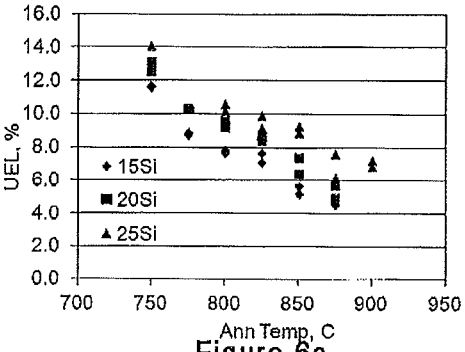
Figure 6D:
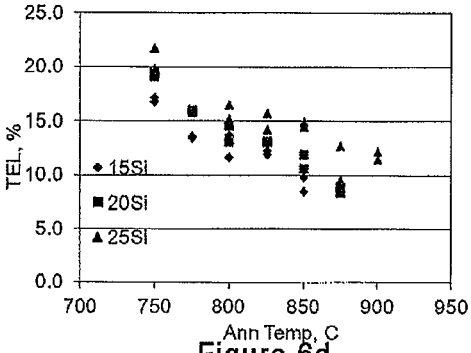
Figure 6E:
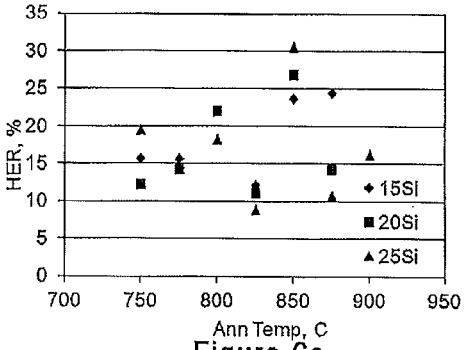
Figure 6F:
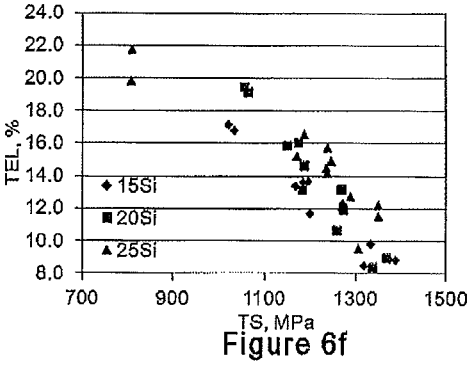
FIG. 6*f* plots TE vs TS for the samples of Table 4A.

FIGS. 6*a*-6*e* plot the tensile properties versus annealing temperature for the samples of Table 4A. FIG. 6*f* plots TE vs TS for the samples of Table 4A.

Figure 7A:
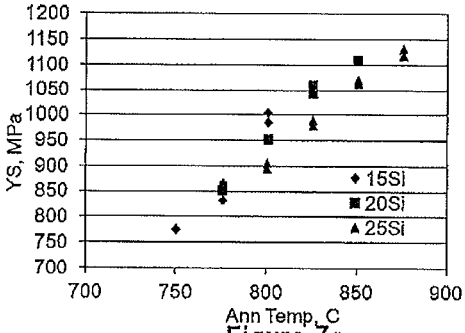
FIGS. 7*a*-7*e* plot the tensile properties versus annealing temperature for the samples of Table 4B.
Figure 7B:
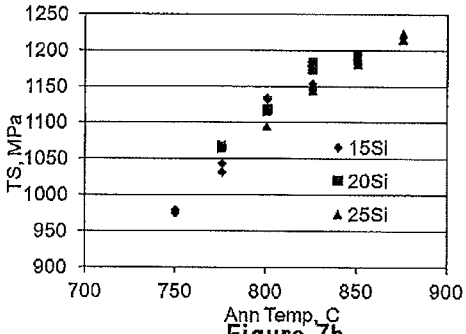
Figure 7C:
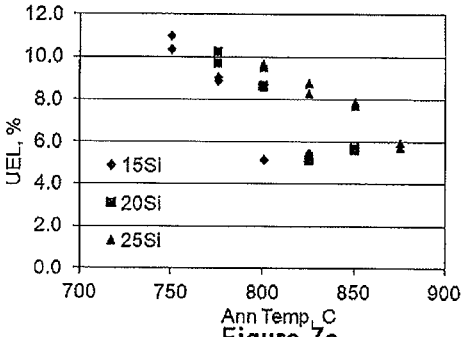
Figure 7D:
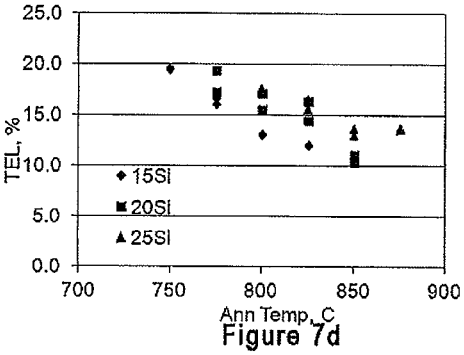
Figure 7E:
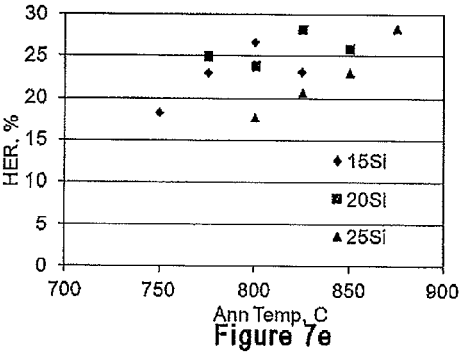
Figure 7F:
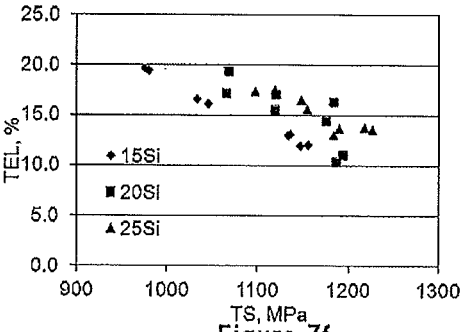
FIG. 7*f* plots TE vs TS for the samples of Table 4B.

FIGS. 7*a*-7*e* plot the tensile properties versus annealing temperature for the samples of Table 4B. FIG. 7*f* plots TE vs TS for the samples of Table 4B.

As can be seen, the strength (both TS and YS) increase with increasing annealing temperature for both 200 and 420° C. overaging temperature. Also, the elongation (both TE and UE) decrease with increasing annealing temperature for both 200 and 420° C. overaging temperature. On the other hand, the Hole Expansion (HE) does not seem to be affected in any discernable way by annealing temperature, but the increase in the OA temperature seems to raise the average HE somewhat. Finally, the different OA temperatures do not seem to have any effect on the plots of TE vs TS.

It is to be understood that the disclosure set forth herein is presented in the form of detailed embodiments described for the purpose of making a full and complete disclosure of the present invention, and that such details are not to be interpreted as limiting the true scope of this invention as set forth and defined in the appended claims.

TABLE 4A

| Serial | Si | AT, C. | OAT, C. | Gauge | YS0.2 | TS | UE | TE |
|---|---|---|---|---|---|---|---|---|
| 301469 | 1.5 | 750 | 200 | 1.45 | 522 | 1032 | 11.7 | 16.9 |
| 301470 | 1.5 | 750 | 200 | 1.47 | 524 | 1021 | 11.6 | 17.2 |
| 300843 | 1.5 | 775 | 200 | 1.50 | 643 | 1184 | 8.8 | 13.7 |
| 300844 | 1.5 | 775 | 200 | 1.52 | 630 | 1166 | 8.9 | 13.5 |
| 300487 | 1.5 | 800 | 200 | 1.46 | 688 | 1197 | 7.7 | 11.8 |
| 300488 | 1.5 | 800 | 200 | 1.46 | 675 | 1195 | 7.9 | 13.8 |
| 300505 | 1.5 | 825 | 200 | 1.51 | 765 | 1271 | 7.7 | 12.4 |
| 300506 | 1.5 | 825 | 200 | 1.47 | 781 | 1269 | 7.1 | 12.0 |
| 300493 | 1.5 | 850 | 200 | 1.48 | 927 | 1333 | 5.7 | 9.9 |
| 300494 | 1.5 | 850 | 200 | 1.44 | 970 | 1319 | 5.2 | 8.6 |
| 300511 | 1.5 | 875 | 200 | 1.50 | 1066 | 1387 | 4.7 | 8.9 |
| 300512 | 1.5 | 875 | 200 | 1.50 | 1075 | 1373 | 4.6 | 9.0 |

TABLE 4A-continued

| Serial | Si | AT, C. | OAT, C. | Gauge | YS0.2 | TS | UE | TE |
|---|---|---|---|---|---|---|---|---|
| 301471 | 2 | 750 | 200 | 1.54 | 532 | 1056 | 13.1 | 19.5 |
| 301472 | 2 | 750 | 200 | 1.56 | 543 | 1062 | 12.6 | 19.2 |
| 300845 | 2 | 775 | 200 | 1.53 | 606 | 1173 | 10.3 | 16.1 |
| 300846 | 2 | 775 | 200 | 1.57 | 595 | 1148 | 10.3 | 15.9 |
| 300489 | 2 | 800 | 200 | 1.40 | 623 | 1180 | 9.2 | 13.2 |
| 300490 | 2 | 800 | 200 | 1.37 | 629 | 1186 | 9.6 | 14.7 |
| 300507 | 2 | 825 | 200 | 1.41 | 703 | 1268 | 8.4 | 13.2 |
| 300508 | 2 | 825 | 200 | 1.42 | 695 | 1265 | 8.7 | 13.2 |
| 300495 | 2 | 850 | 200 | 1.40 | 748 | 1257 | 6.4 | 10.7 |
| 300496 | 2 | 850 | 200 | 1.40 | 779 | 1272 | 7.4 | 12.0 |
| 300513 | 2 | 875 | 200 | 1.37 | 978 | 1366 | 5.7 | 9.0 |
| 300514 | 2 | 875 | 200 | 1.41 | 956 | 1335 | 4.9 | 8.4 |
| 301473 | 2.5 | 750 | 200 | 1.67 | 476 | 809 | 14.1 | 21.8 |
| 301474 | 2.5 | 750 | 200 | 1.45 | 481 | 807 | 12.6 | 19.9 |
| 300491 | 2.5 | 800 | 200 | 1.41 | 605 | 1168 | 10.2 | 15.3 |
| 300492 | 2.5 | 800 | 200 | 1.46 | 624 | 1184 | 10.6 | 16.6 |
| 300509 | 2.5 | 825 | 200 | 1.44 | 657 | 1237 | 9.2 | 14.3 |
| 300510 | 2.5 | 825 | 200 | 1.45 | 652 | 1235 | 9.9 | 15.8 |
| 300497 | 2.5 | 850 | 200 | 1.40 | 690 | 1245 | 9.3 | 15.0 |
| 300498 | 2.5 | 850 | 200 | 1.42 | 684 | 1233 | 8.9 | 14.6 |
| 300515 | 2.5 | 875 | 200 | 1.47 | 796 | 1285 | 7.6 | 12.8 |
| 300516 | 2.5 | 875 | 200 | 1.46 | 812 | 1305 | 6.2 | 9.6 |
| 300847 | 2.5 | 900 | 200 | 1.45 | 860 | 1347 | 7.2 | 12.3 |
| 300848 | 2.5 | 900 | 200 | 1.42 | 858 | 1347 | 6.9 | 11.6 |

TABLE 4B

| Serial | Si | AT, C. | OAT, C. | Gauge | YS0.2 | TS | UE | TE |
|---|---|---|---|---|---|---|---|---|
| 301451 | 1.5 | 750 | 420 | 1.57 | 780 | 976 | 11.0 | 19.7 |
| 301452 | 1.5 | 750 | 420 | 1.55 | 778 | 980 | 10.4 | 19.6 |
| 301453 | 1.5 | 775 | 420 | 1.42 | 868 | 1045 | 8.9 | 16.2 |
| 301454 | 1.5 | 775 | 420 | 1.44 | 834 | 1033 | 9.1 | 16.7 |
| 301455 | 1.5 | 800 | 420 | 1.44 | 989 | 1133 | 5.2 | 13.1 |
| 301456 | 1.5 | 800 | 420 | 1.42 | 1007 | 1135 | 5.2 | 13.2 |
| 301031 | 1.5 | 825 | 420 | 1.46 | 1060 | 1155 | 5.4 | 12.2 |
| 301032 | 1.5 | 825 | 420 | 1.46 | 1060 | 1146 | 5.5 | 12.1 |
| 301457 | 2 | 775 | 420 | 1.52 | 855 | 1065 | 9.8 | 17.3 |
| 301458 | 2 | 775 | 420 | 1.52 | 855 | 1068 | 10.3 | 19.4 |
| 301459 | 2 | 800 | 420 | 1.56 | 954 | 1120 | 8.7 | 17.2 |
| 301460 | 2 | 800 | 420 | 1.55 | 954 | 1118 | 8.7 | 15.6 |
| 301461 | 2 | 825 | 420 | 1.53 | 1043 | 1175 | 5.2 | 14.5 |
| 301462 | 2 | 825 | 420 | 1.54 | 1062 | 1184 | 5.2 | 16.4 |
| 301033 | 2 | 850 | 420 | 1.40 | 1111 | 1186 | 5.7 | 10.4 |
| 301034 | 2 | 850 | 420 | 1.37 | 1112 | 1194 | 5.8 | 11.1 |
| 301463 | 2.5 | 800 | 420 | 1.53 | 906 | 1118 | 9.6 | 17.6 |
| 301464 | 2.5 | 800 | 420 | 1.55 | 896 | 1097 | 9.7 | 17.5 |
| 301465 | 2.5 | 825 | 420 | 1.67 | 991 | 1154 | 8.3 | 15.7 |
| 301466 | 2.5 | 825 | 420 | 1.66 | 983 | 1147 | 8.8 | 16.6 |
| 301467 | 2.5 | 850 | 420 | 1.55 | 1071 | 1189 | 7.9 | 13.8 |
| 301468 | 2.5 | 850 | 420 | 1.54 | 1064 | 1183 | 7.8 | 13.1 |
| 301035 | 2.5 | 875 | 420 | 1.41 | 1120 | 1217 | 5.8 | 13.9 |
| 301036 | 2.5 | 875 | 420 | 1.46 | 1132 | 1225 | 6.0 | 13.7 |

What is claimed:

1. A dual phase steel sheet having a microstructure containing ferrite and tempered martensite and having a tensile strength of at least 980 MPa, a total elongation of at least 15%, and a hole expansion ratio of at least 15% said dual phase steel sheet manufactured by a process comprising the steps of:

providing a dual phase hot rolled steel sheet having a microstructure containing ferrite and martensite and having a composition including:

0.1-0.3 wt. % C;

1.5-2.5 wt. % Si;

1.75-2.5 wt. % Mn;

annealing said hot rolled steel sheet at a temperature from 750 to 875° C.;

water quenching said hot rolled steel sheet to a temperature from 400 to 420° C.; and overaging said steel sheet at said temperature from 400 to 420° C. to convert the martensite in said hot rolled steel sheet to tempered martensite;

said overaging sufficient to provide said hot rolled steel sheet with said hole expansion ratio of at least 15%.

2. The dual phase steel of claim 1, wherein said steel has a total elongation of at least 18%.

3. The dual phase steel of claim 1, wherein said steel has a tensile strength of at least 1180 MPa.

4. The dual phase steel of claim 1, wherein said steel includes between 0.14-0.21 wt. % C.

5. The dual phase steel of claim 4, wherein said steel includes less than 0.19 wt. % C.

6. The dual phase steel of claim 4, wherein said steel includes about 0.15 wt. % C.

7. The dual phase steel of claim 1, wherein said steel includes about 1.8-2.2 wt. % Mn.

8. The dual phase steel of claim 1, wherein said steel further includes between 0.05-1 wt. % Al.

9. The dual phase steel of claim 8, wherein said steel further includes between 0.005-0.1 wt. % total of one or more elements selected from the group consisting of Nb, Ti, and V.

10. The dual phase steel of claim 1, wherein said steel further includes between 0-0.3 wt. % Mo.

11. The product of claim 1, wherein said dual phase steel sheet has a hole expansion ratio of at least 20%.

12. The product of claim 1, wherein said dual phase steel sheet has a hole expansion ratio of at least 25%.

* * * * *